US005375355A

United States Patent [19]

Rhoads

[11] Patent Number: 5,375,355

[45] Date of Patent: Dec. 27, 1994

[54] THEFTPROOF STREET SIGN ASSEMBLY

[76] Inventor: Michael L. Rhoads, 229 Lowland Rd., Hamburg, Pa. 19526

[21] Appl. No.: 46,080

[22] Filed: Apr. 12, 1993

[51] Int. Cl.[5] ..... G09F 15/00

[52] U.S. Cl. ..... 40/607; 40/612; 403/269

[58] Field of Search ..... 40/606, 607, 612, 616; 403/267, 268, 269, DIG. 2

[56] References Cited

U.S. PATENT DOCUMENTS

| | | | |
|---|---|---|---|
| 1,684,470 | 9/1928 | Butler | 40/607 |
| 1,888,246 | 11/1932 | Sprung | 40/607 |
| 2,065,097 | 12/1936 | Rogers | 40/607 |
| 3,218,746 | 11/1965 | Hawkins . | |
| 3,529,798 | 9/1970 | Williams et al. . | |
| 3,935,655 | 2/1976 | Fritzinger . | |
| 4,262,438 | 4/1981 | Scherer | 40/607 |
| 4,516,615 | 5/1985 | Finn | 403/267 X |
| 4,555,775 | 6/1984 | Fritzinger | 40/607 |
| 4,854,063 | 8/1989 | Brunell | 40/607 |

FOREIGN PATENT DOCUMENTS

| | | | |
|---|---|---|---|
| 304896 | 1/1929 | United Kingdom | 403/269 |

*Primary Examiner*—Brian K. Green
*Attorney, Agent, or Firm*—Eckert Seamans Cherin & Mellott

[57] ABSTRACT

A street identification sign and supporting post assembly designed to be essentially theftproof and vandalproof. The sign boards are preferably made of cast aluminum and contain an integrally cast elongated rod that is also cast into the open top of the supporting post. The various components of the assembly are all integrally joined together with cast metal into a unitary street sign structure or assembly. Also disclosed is a method for producing the unitary structure or assembly using aluminum castings.

6 Claims, 2 Drawing Sheets

FIG. 1
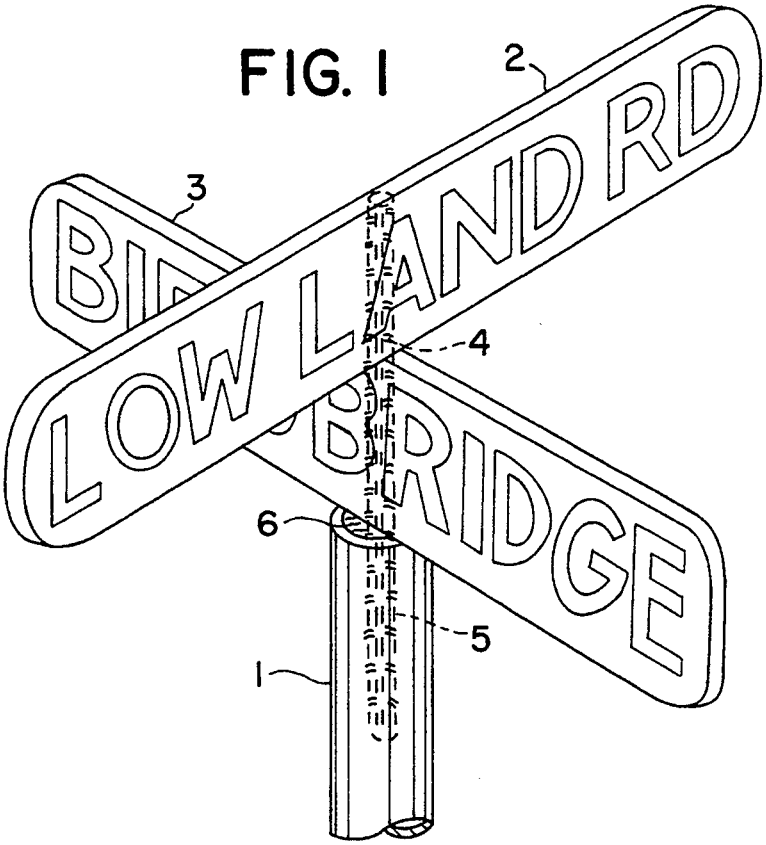
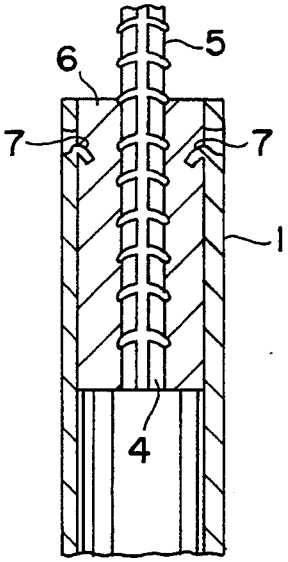
FIG. 2
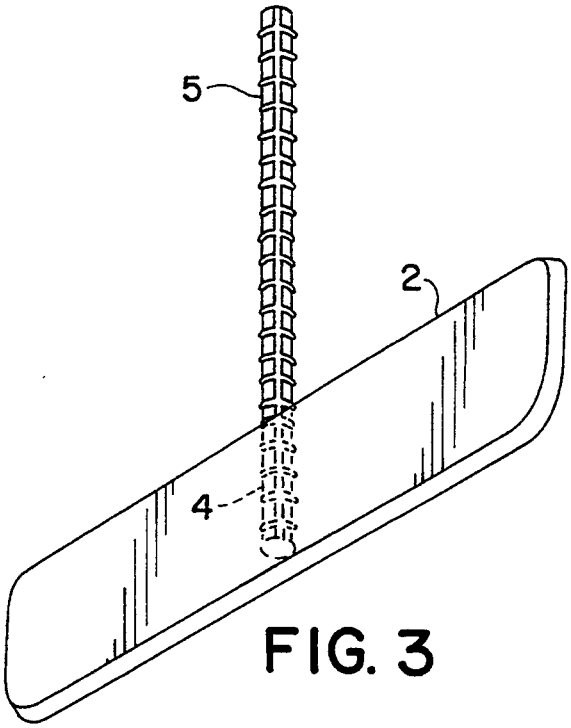
FIG. 3

THEFTPROOF STREET SIGN ASSEMBLY

BACKGROUND OF THE INVENTION

This invention relates to a street identification sign and supporting post assembly, It relates particularly to means for securing street sign boards to the top of a vertical tubular support post in a manner to make the signs essentially vandal and theft proof.

Street signs are frequently subjected to various forms of abuse and vandalism that require considerable replacement, repair and maintenance expense. Vandals often break the signs from the supporting posts and carry them away or rotate the signs 90 degrees to misdirect or confuse the traveler. In addition to vandalism and theft, street signs are subject to all types of traffic hazards and wind and weather conditions that often loosen or destroy the signs and make the assembly ineffective until repaired or replaced.

A number of prior patents have disclosed street sign assemblies designed to resist theft, vandalism and damage. U.S. Pat. No. 3,935,655 to Fritzinger (1976), U.S. Pat. No. 4,455,775 to Fritzinger (1984) and U.S. Pat. No. 4,854,063 to Brunell (1989) all disclose attempts to make street sign assemblies vandal and theft proof. These prior designs use internal, hidden threaded fasteners to secure the signs to the supporting post. By hiding the fasteners used to attach the signs to the supporting post, the removal of the signs by vandals is discouraged, but not prevented. These prior designs however, usually required a large number of separate parts and fasteners and special tools which made the assembly or disassembly of these prior sign post assemblies in the field difficult and significantly increased the cost of the assembly.

SUMMARY OF THE INVENTION

It is therefore an object of this invention to provide a street identification sign and supporting post assembly that is simple and easily adapted to many existing street sign designs.

It is a further object of this invention to provide a street identification sign and supporting post assembly that is essentially theftproof and vandalproof and one that cannot be easily destroyed, damaged or rotated.

It is a still further object of this invention to provide a street identification sign and supporting post assembly that can be easily and inexpensively manufactured and installed.

I have discovered that the foregoing objects can be attained by an integral cast metal street identification sign and supporting post assembly comprising a tubular post member, a first street sign board made of cast metal, a second street sign board made of cast metal and positioned at right angles to the first street sign board. An elongated rod member is cast integrally into the first and second street sign boards and into the top of the tubular post member whereby the parts are integrally joined together with cast metal into a unitary street sign structure or assembly.

BRIEF DESCRIPTION OF THE DRAWINGS

FIG. 1 is an isometric view of a two sign board street sign assembly of this invention to illustrate details of this invention.

FIG. 2 is a sectional view of the top portion of the supporting tubular post to illustrate details of this invention.

FIG. 3 is an isometric view of the top or first street sign board used in the street sign assembly according to this invention.

DESCRIPTION OF THE PREFERRED EMBODIMENTS

Figure 4:
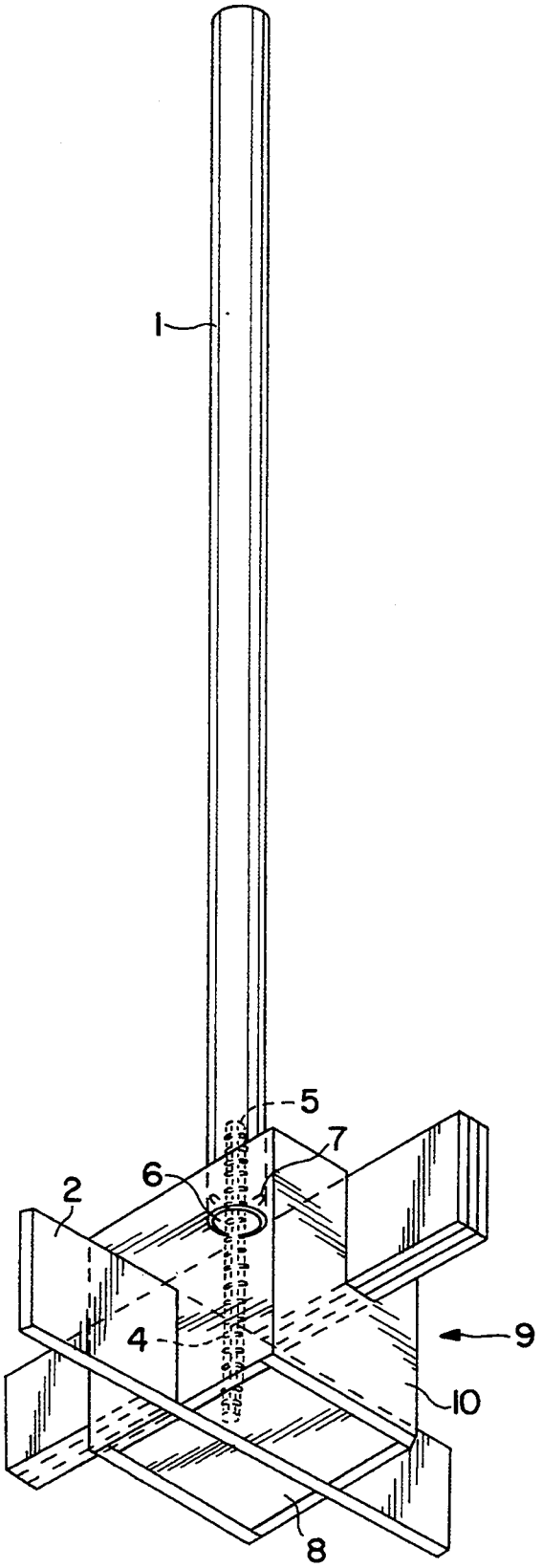
FIG. 4 is an isometric view of the mold assembly and casting equipment used to illustrate a method for producing a street sign assembly according to this invention.

In FIG. 1, there is illustrated a preferred embodiment of a two street identification sign and supporting post assembly of this invention. The assembly shown in FIG. 1 comprises a tubular post member 1 made of aluminum or steel and sufficient length and diameter to support the assembly at a street intersection. A top or first street sign board 2 preferably made of cast metal, such as aluminum, and a bottom or second sign board 3 also preferably made of cast metal are positioned at right angles to each other for use at a typical four way street intersection.

As shown in FIG. 3, the top or first sign board 2, which is shown inverted in this FIG. 3, is cast with an elongated metal rod 4, preferably made of steel, integrally bonded into the middle of the cast first or top sign board 2 with a portion 5 of the elongated metal rod 4 projecting from one edge of the first or top sign board 2, as best illustrated in FIG. 3.

In the complete sign and post assembly, illustrated in FIG. 1, the projecting portion 5 of the elongated metal rod 4 is also cast integrally into the body of the lower or second sign board 3 and into the open top 6 of the tubular post member 1.

As will be described below in more detail and as illustrated in FIG. 2, the preferred method of producing the street sign and supporting post assembly of this invention, will allow the molten metal used to cast the lower or second sign board 3 to also integrally bond the sign board 3 to the elongated rod member 4 and to the open top 6 of the tubular post member 1 by allowing a portion of the molten metal being used to cast the lower or second sign post 3 to flow into the open top 6 of the tubular post member 1.

As shown in FIG. 2, the open top 6 portion of the tubular post member 1 is preferably provided with a plurality of openings and tabs 7 punched out of the wall of the tubular post member 1 to provide a plurality of locking members and keys which will mechanically bond the molten cast metal to internal wall surface of the open top portion 6 of the tubular post member 1. If desired, other types of mechanical bonding means may be inserted in the open top 6 of the tubular post member 1, such as a fabricated wire spider or cage, to provide a suitable means for bonding the cast molten metal to the tubular post member 1.

I have illustrated in FIG. 4, the mold assembly and casting set up used to economically produce the street identification sign and supporting post assembly of this invention. As shown in FIG. 4, the first or top sign board 2 is cast separately as illustrated in FIG. 3, with the elongated metal rod 4 cast integrally into the middle of the first or top sign board 2 and with a portion 5 of the rod 4 projecting from one edge of the first or top sign board 2, as shown in FIG. 3.

The first or top sign board 2, after it has been cast, cooled and removed from its mold, is positioned on the base 8 of a mold assembly 9 shown in FIG. 4. A mold 10 of cast iron, graphite, bonded sand or other refractory material and having a cavity conforming to the shape of the bottom or second sign board 3 is then positioned on top of the first or top sign board 2 with the projecting portion 5 of the rod 4 extending through the center of the mold 10 and several inches beyond the top of the mold 10. The open end 6 of the tubular post member 1 is then placed over the still projecting end portion 5 of the rod 4 so that the projecting end portion 5 of rod 4 extends centrally and several inches into the open end 6 of the tubular post member 1. The tubular post member 1 is then aligned vertically and supported in an a vertical position during the cast.

Molten metal, such as molten aluminum, is then poured into the gate of the mold assembly 9 where the molten metal first fills the cavity in mold 10 thereby forming the bottom or second sign board 3 and then flows upwardly into the open end 6 of the tubular post member 1 which serves as a riser for the mold 10. The molten metal flowing into the open end 6 of the tubular post member flows around and into the tabs and openings 7 formed in the wall of the tubular post member 1 as well as completely around the projecting end 5 of the rod 4. When the molten metal cools and solidifies, it integrally bonds and joins permanently together the first and second sign boards 2 and 3 and the supporting post 1. The cast-in internal rod 4 provides considerable lateral support for the entire structure and effectively prevents any future disassembly or rotation of the sign boards 2 and 3.

Upon completion of the street sign and supporting post assembly as described above, the sign boards 2 and 3 may be painted or overlaid with vinyl lettering to label the street signs for the intersection to be identified and labeled.

While I have described the preferred embodiment of this invention as having the first and second signboards 2 and 3 cast from molten metal, such as aluminum, and generally illustrated as being flat and rectangular in shape, it is within the scope of this invention to make the signboards in shapes other than flat and rectangular and to cast the assembly using other castable metals, such as bronze or iron, or even to use a non-metallic castable material, such as plastic or rubber, so long as the castable material will bond integrally with the internal rod 4 and the open end portion 6 of the supporting post 1.

While I have described this invention and a method for producing the invention by illustrating and describing a preferred embodiment of it, I have done so by way of example, and am not to be limited thereby, as there could be modifications and adaptions to this invention without departure from its scope.

I claim:

1. An integral unitary cast metal sheet identification sign and supporting post assembly, comprising a tubular post member, a first sign board made of cast metal, a second sign board made of cast metal and positioned at substantially right angles to said first sign board, and an elongated rod member cast integrally into said first and second sign boards and cast integrally into an open end portion of said tubular post member, the post member, the first and second sign boards, and the elongated rod member being bonded together with cast metal to form the unitary assembly.

2. The assembly of claim 1 in which the first sign board and the second sign board are cast from molten aluminum.

3. The assembly of claim 1 in which the elongated rod member is made of steel.

4. The assembly of claim 1 in which the open end portion of the tubular post member is provided with means to mechanically bond cast metal to the internal surface of the open end portion of the tubular post member.

5. The assembly of claim 4 in which the mechanical bond means comprises a plurality of openings and tabs punched from the open end portion of said tubular post member.

6. An integral unitary cast street identification sign and supporting post assembly, comprising a tubular post member, a first sign board made of cast material, a second sign board made of cast material and positioned at substantially right angles to said first sign board, and an elongated rod member cast integrally into said first and second sign boards and cast integrally into an open end portion of said tubular post member, the post member, the first and second sign boards, and the elongated rod member being bonded together with cast material to form the unitary assembly.

* * * * *